United States Patent [19]

Attig

[11] Patent Number: 4,589,661

[45] Date of Patent: May 20, 1986

[54] GOLF BALL AND TEE MANIPULATING APPARATUS

[76] Inventor: George B. Attig, 642 Calfax Ct., Goleta, Calif. 93117

[21] Appl. No.: 637,130

[22] Filed: Aug. 2, 1984

[51] Int. Cl.[4] ..... A63B 57/00

[52] U.S. Cl. ..... 273/32.5

[58] Field of Search ..... 273/33, 32 B, 32.5, 273/32 D; 294/19.2, 19.1

[56] References Cited

U.S. PATENT DOCUMENTS

| | | | |
|---|---|---|---|
| 1,863,140 | 6/1932 | Mulvaney | 273/32.5 |
| 2,606,764 | 8/1952 | Mason | 273/32.5 |
| 2,609,198 | 9/1952 | Armstrong | 273/325 |
| 2,801,852 | 8/1957 | Hollle | 273/32.5 |
| 2,943,856 | 7/1960 | Eimerman | 273/32.5 |
| 3,206,197 | 9/1965 | Miotke | 273/32.5 |
| 3,889,946 | 6/1975 | Setecka | 273/32.5 |
| 3,904,200 | 9/1975 | Jackle | 273/32.5 |
| 4,013,295 | 3/1977 | Baughman | 273/32.5 |
| 4,313,604 | 2/1982 | Baxter | 273/32.5 |
| 4,360,199 | 11/1982 | Jackson | 273/32.5 |
| 4,526,369 | 7/1985 | Phelps | 273/32.5 |

*Primary Examiner*—Richard C. Pinkham
*Assistant Examiner*—T. Brown
*Attorney, Agent, or Firm*—William W. Haefliger

[57] ABSTRACT

Golf ball and tee manipulating apparatus, comprises:

a vertically elongated shaft or shafts, a claw carried on the lower end of one shaft and having tines, to receive and support the head portion of a golf ball tee, generally between the tines, a holder carried by a shaft to project sidewardly above the claw and form therewith a space to receive a golf ball at one side of the shaft, with the ball retained between the holder and the head of the tee, whereby downward force is transmissible from the shaft to the holder, and then through the ball to the tee to insert the tee in the ground, and an adjuster carried on an upper end portion of the shaft or shafts for effecting relative vertical displacement of the holder and claw, to allow sideward release of the holder and claw from the ball and tee.

9 Claims, 10 Drawing Figures

GOLF BALL AND TEE MANIPULATING APPARATUS

BACKGROUND OF THE INVENTION

This invention relates generally to the manipulation of golf balls and tees, as in preparation for driving the ball from the tee; more particularly it concerns provision of a light weight, portable device used to place a golf tee into the ground with a golf ball resting on the tee to the individual golfer's choice of heights without stooping or bending over.

The height that a ball is teed is a golfer's individual choice and will usually vary with the particular club that the golfer is using, i.e., driver, 3 wood, iron, etc. Needed is a device that allows the golfer to insert the tee to any desired depth visually, with the ball in place on the tee, just as he would if he were teeing up without such a device. Prior devices either, (1) don't have the ball resting on the tee while inserting it in the ground, or (2) have a mechanical stop which needs adjusting for various height settings and which interferes with removing the device from the tee and the ball, or (3) are so bulky that they restrict the golfer's perception of how high the ball is teed.

SUMMARY OF THE INVENTION

It is a major object of the invention to provide for foolproof insertion of the tee into the ground and removal of the device from the teed ball. As will appear, the insertion of the tee into the ground with the ball resting on it is accomplished by holding the tee and the ball between a claw and a holder and under a load and then by transferring force from shaft means to the holder, ball and tee. There are no moving parts involved in this transfer of force that could cause the ball to fall off the tee.

Basically, then, the invention comprises:

(a) vertically elongated shaft means, (b) a claw or foot carried on the lower end of the shaft means and having tines to receive and support the head portion of a golf ball tee, between the tines, (c) a holder carried by the shaft means to project sidewardly above the claw and form therewith a space to receive a golf ball at one side of the shaft means, with the ball retained between the holder and the head of the tee, whereby downward force is transmissible from the shaft means to the holder, and then through the ball to the tee to insert the tee in the ground, (d) and adjustment means carried on an upper end portion of the shaft means for effecting relative vertical displacement of the holder and claw, to allow sideward release of the holder and claw from the ball and tee.

As will appear, the device provides for foolproof insertion of the tee into the ground and removal of the device from the teed ball. The insertion of the tee into the ground with the ball resting on it is accomplished by holding the tee and the ball between the claw and holder or "hold down", as under a spring load, and then by transferring force from a pistol grip handle to the outer tube, "hold down", and ball. There are no moving parts involved in this transfer of force that could cause the ball to fall off the tee. The "hold down" has a seat to locate the ball directly over the tee during such transfer of force.

Additional objects include the location of one of the shafts to extend within the other, the claw attached to the lower end of said one shaft, and a pusher attached to the upper end of said one shaft; the provision of a recess formed by the holder to face downwardly toward the locus of a tee received by the claw, and sized to engage and center the uppermost portion of a golf ball in alignment with the tee; and the use of a compression spring operatively connected between said shafts to yieldably urge the claw carried by one of the shafts relatively upwardly toward the foot carried by the other of said shafts. Further, the claw typically has a bottom surface which is convex downwardly, and the tines have upper surfaces which are concave upwardly; a spike is operatively connected to said shaft means to extend at one side thereof and for displacement between an upwardly projecting retracted position, and a downwardly projecting extended position in which the spike is insertable into the ground to support the shaft means; and the holder pivotally supports the spike to swing downwardly toward extended position at the side of the shaft means opposite the claw.

These and other objects and advantages of the invention, as well as the details of an illustrative embodiment, will be more fully understood from the following specification and drawings, in which:

DRAWING DESCRIPTION

DETAILED DESCRIPTION

Figure 1:
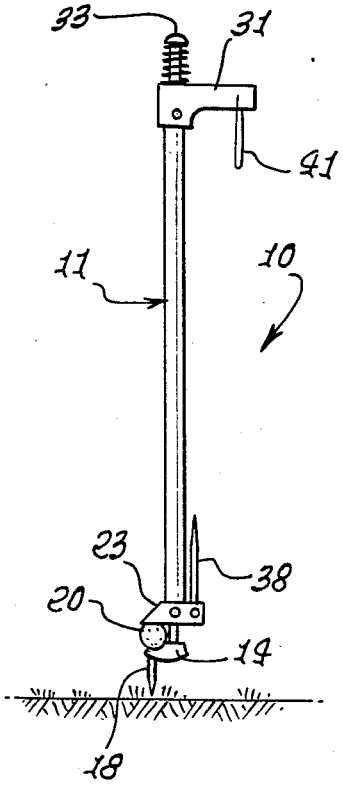
FIG. 1 is a side elevation showing apparatus incorporating the invention, just prior to tee insertion in the ground.
Figure 2:
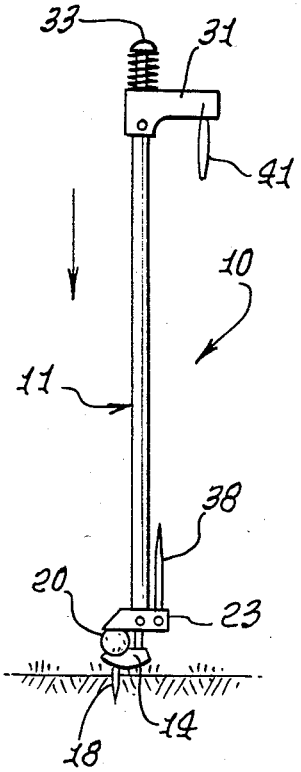
FIG. 2 is a view like FIG. 1, showing the apparatus at the time of tee insertion.

Referring first to FIGS. 5–10, the golf ball and tee manipulating apparatus 10 comprises vertically elongated shaft means generally indicated at 11; more specifically, the shaft means may with unusual advantage include relatively vertically movable shafts 12 and 13, which are typically coaxial.

A claw or foot 14 is carried at the lower end of the shaft means 11, and typically by the lower end portion 13*a* of inner shaft 13, shown as movable up and down within shaft 12. In this regard, the shaft lower end portion 13*a* may be received in a recess 14*b* in the claw body 14*a* and attached by a pin 15 to that body. The claw has two tines 16 which are laterally spaced apart so as to support the head 17 of a tee 18, as within a tapered recess 19 sunk downwardly within the claw. The tee is shown in broken lines 18' in FIG. 7, as is the tee head at 17'. The position of the golf ball 20 seated on the tee is indicated at 20' in FIG. 7. The claw is movable sidewardly out from under the tee head, such recess 19 intersects the space 21 formed between the tines, and the tines are beveled along their lengths at 16*a* to relatively pass the tapered tee head. See FIG. 8.

A holder 23 is carried by the shaft means, as for example by outer shaft 12, to project sidewardly above the claw and form therewith a space 24 to receive the golf ball 20 at one side of the shafts. The ball is thereby retained between the holder and the head of the tee, whereby downward force is transmissible from the shaft means (shaft 12 for example) to the holder, and then through the ball to the tee to insert the tee into the turf, i.e. ground. To this end, the holder is rigidly attached to the outer sleeve, as for example by a pin 25 passing laterally through the holder and the outer tubular shaft 12, the pin also passing through a vertical slot or cut-out 26 in the inner shaft, which allows that inner shaft and claw 14 to be moved up and down relative to the holder 23. Note the spherical section surface 27 formed in the underside of the holder to face downwardly directly above the tee, and sized to engage and center the uppermost portion of the golf ball indicated at 20*a*′ in FIG. 7.

Figure 3:
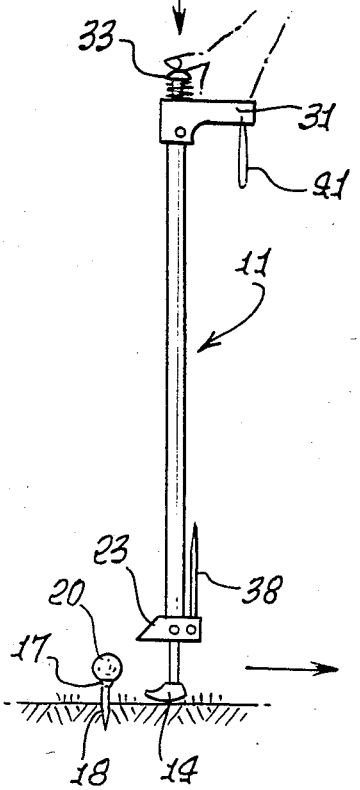
FIG. 3 is a view like FIGS. 1 and 2, showing the apparatus just after retraction away from the inserted tee, with a golf ball remaining on the tee.

It will also be noted that the claw has an upper surface 28, closer to the shafts than the tines, which is concave upwardly to sidewardly support the golf ball. The tine upper surfaces are also concave upwardly. The bottom surface 29 of the claw is convex downwardly so as to be freely slidable on the turf, and sidewardly during sideward release of the golf ball and tee, as indicated in FIG. 3.

Adjustment means is curved on the upper end portion of the shaft means, for effecting relatively vertical displacement of the holder and claw, allowing sideward release of the holder and claw from the ball and tee. The illustrated adjustment means includes a handle 31 secured on one of the two shafts, as for example shaft 12 to which the handle is pin connected at 32. A pusher 33 is on the other shaft (shaft 13 in this instance) and proximate the handle, and it allows downward pressure application on the exposed upper end of shaft 13 to depress shaft 13 and claw 14 relative to handle 31, shaft 12 and holder 23. When so depressed, or downwardly displaced, the claw and holder are sufficiently spaced apart to allow insertion of a golf ball into space 24, into position above a tee head, and also sideward release of the golf ball and tee, as in FIG. 3.

A compression spring 34 may be operatively connected between the two shafts, thereby to slidably urge the claw relatively upwardly toward the holder. See for example the location of the ends of the spring 34 between the pusher 33, and the bottom wall 35 of the recess 36 in handle 31. Recess 36 receives and centers the helical compression spring which surrounds the two shafts, in the example. A vertical slot 37 in shaft 13 passes the pin 32, to allow up and down movement of shaft 13 relative to shaft 12.

Figure 4:
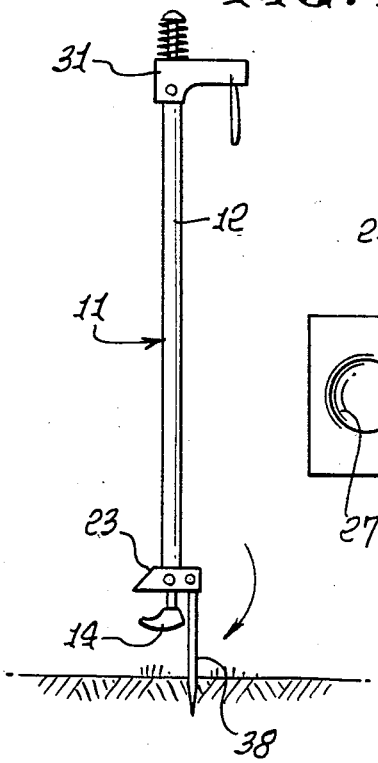
FIG. 4 is a side elevation showing spike support of the apparatus.
Figure 10:
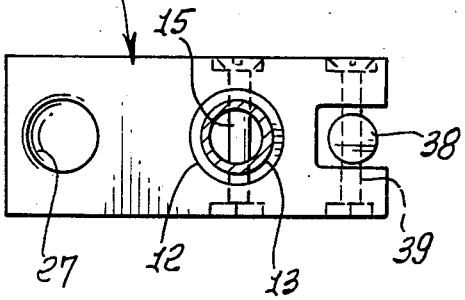
FIG. 10 is a horizontal section on lines 10—10 of FIG. 7.
Figure 9:
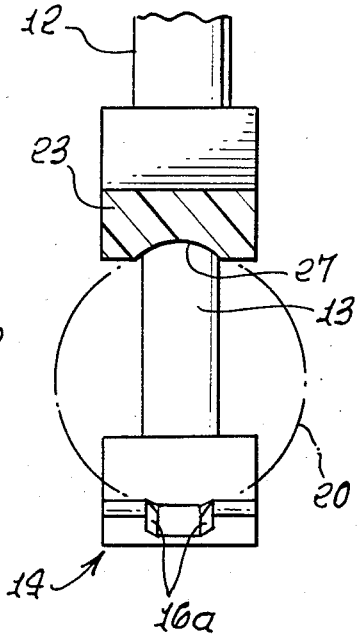
FIG. 9 is a vertical section on lines 9—9 of FIG. 7.
Figure 5:
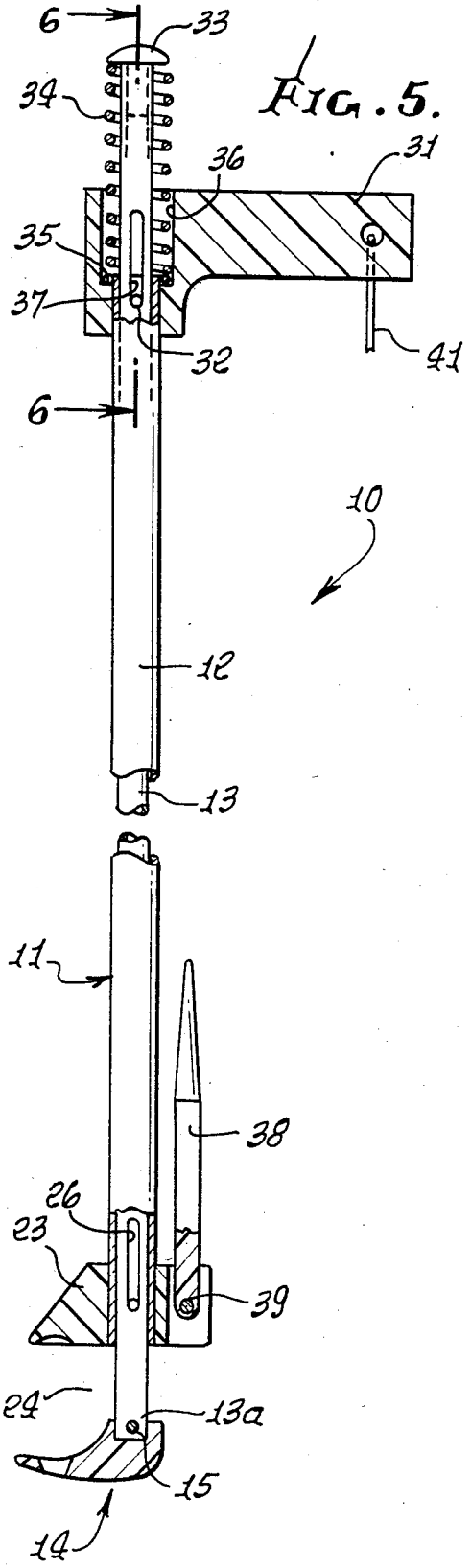
FIG. 5 is an enlarged side elevation of the FIG. 1 apparatus, and partly in section to show detailed construction.
Figure 6:
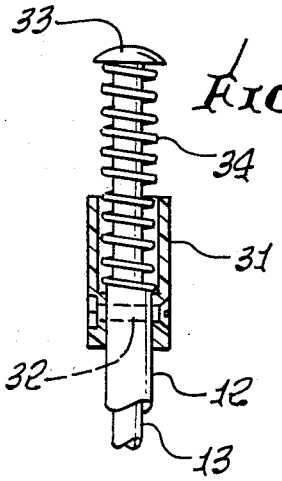
FIG. 6 is a vertical section on lines 6—6 of FIG. 5.
Figure 8:
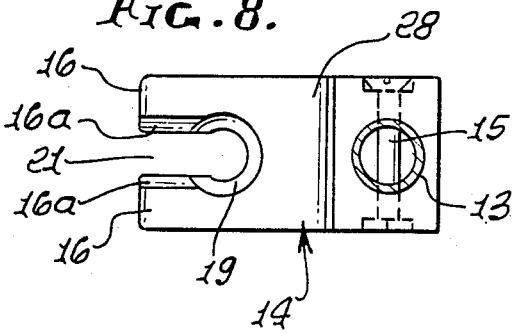
FIG. 8 is a horizontal section on lines 8—8 of FIG. 7.
Figure 7:
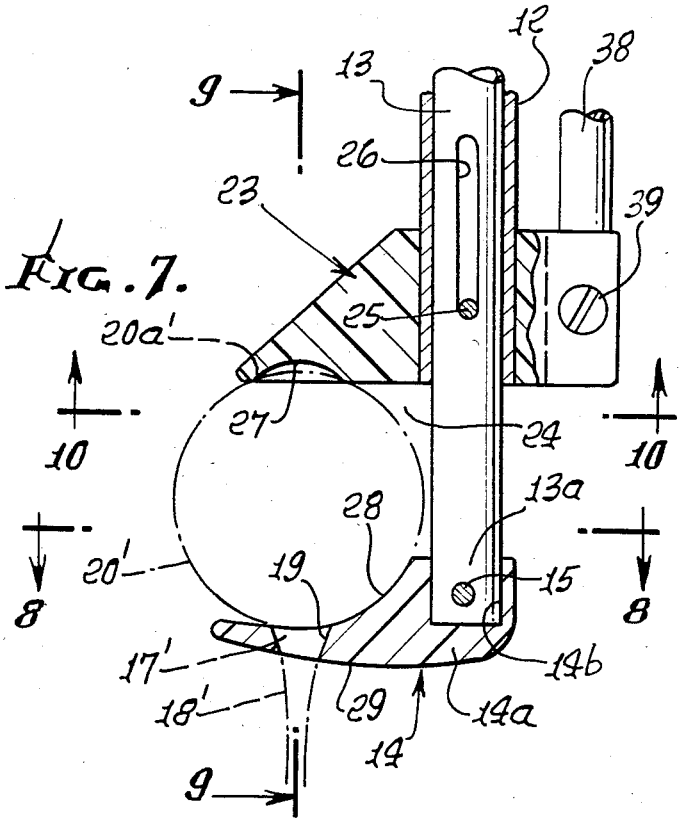
FIG. 7 is a further enlarged view in vertical section showing golf ball support by the FIG. 1–6 apparatus.

Finally, a spike 38 is connected to holder 23, as by a pin 39, so as to be swingable between an upwardly retracted position (see FIG. 5), and a downwardly extended position (see FIG. 4). In the latter position, the spike is insertible into the ground to support the device in stand alone position.

The device is easily removed from the teed ball by pressing the pusher 33 which relieves the spring pressure and separates the claw and holder. Then the uniquely curved and tapered foot can be slid out from under the teed ball without making any contact which might otherwise cause the ball to fall off the tee.

Due to the unique construction of the claw and holder the device has two other valuable uses for the golfer that can't, or has difficulty with, stooping, or bending over. First, the shape of the claw allows the golfer to use the claw to pick up the tee after driving the ball. If the tee has remained in the ground, he simply has to slip the tines of the claw under the head of the tee and lift it out. If the tee is laying on the grass, he simply puts the tapered tines under the head, allowing the point of the tee to fall between the tines and lifts it up. Secondly, the combination of the tapered claw and the spring loaded holder or "hold down" allows the user to pick up a golf ball from the cup, ground, ditch, or shallow water.

The fold away spike allows the golfer to stand the devide upright while driving or putting. It can then be retrieved without stooping or bending over. The device has a strap 41 attached to the handle so that it can be hung on the outside of the golf bag by placing the strap over the head of a golf club protruding from the bag. This conserves bag space and protects the device from damage that might be caused by the golf clubs being placed in the bag.

I claim:

1. Golf ball and tee manipulating apparatus, comprising:

(a) vertically elongated shaft means, (b) a claw carried on the lower end of the shaft means and having tines, to receive and support the head portion of a golf ball tee, generally between the tines, (c) a holder carried by the shaft means to project sidewardly above the claw and form therewith a space to receive a golf ball at one side of the shaft means, with the ball retained between the holder and the head of the tee, whereby downward force is transmissible from the shaft means to the holder, and then through the ball to the tee to insert the tee in the ground, (d) and adjustment means carried on an upper end portion of the shaft means for effecting relative vertical displacement of the holder and claw and to allow sideward release of the holder and claw from the ball and tee, (e) said shaft means including relatively vertically movable outer and inner shafts respectively carrying the holder and claw, (f) said adjustment means including a handle rigidly carried on said outer shaft, and an upwardly biased pusher rigidly carried on said inner shaft proximate said handle, said handle being attached to and projecting laterally away from said outer shaft, at one side thereof, and said inner shaft and pusher projecting above the levels of said outer shaft and handle to be manually pressed down when a user's hand grips said handle, thereby to relatively move said claw, relative to said holder.

2. The apparatus of claim 1 wherein said claw is attached to the lower end of said inner shaft, and said pusher is attached to the upper end of said inner shaft.

3. The apparatus of claim 1 including a recess formed in said holder to face downwardly toward the locus of a tee received by said claw, and sized to engage and center the uppermost portion of a golf ball in alignment with a tee.

4. The apparatus of claim 1 including a compression spring operatively connected between said shafts to yieldably urge the claw carried by one of the shafts relatively upwardly toward the holder carried by the other of said shafts.

5. The apparatus of claim 1 wherein said claw has a bottom surface which faces convexly downwardly, and said tines have upper surfaces which faces concavely upwardly.

6. The apparatus of claim 5 wherein said tines are beveled along their lengths to relatively pass a tee head during said sideward release.

7. The apparatus of claim 6 wherein said outer shaft is tubular and extends concentrically about said inner shaft which carries the claw.

8. The apparatus of claim 1 including a strap loop carried by the handle, to hook over a golf club in a golf bag.

9. Golf ball and tee manipulating apparatus, comprising:

(a) vertically elongated shaft means, (b) a claw carried on the lower end of the shaft means and having tines to receive and support the head portion of a golf ball tee, generally between the tines, (c) a holder carried by the shaft means to project sidewardly above the claw and form therewith a space to receive a golf ball at one side of the shaft means, with the ball retained between the holder and the head of the tee, whereby downward force by a user is transmissible from the shaft means to the holder, and then through the ball to the tee to insert the tee in the ground, (d) and adjustment means operable by a user and carried on an upper end portion of the shaft means for effecting relative vertical displacement of the holder and claw, to allow sideward release of the holder and claw from the ball and tee, (e) and including a spike pivotally connected to said holder to extend at one side thereof opposite said claw and for pivotal displacement between an upwardly projecting retracted position, and a downwardly projecting extended position in which the spike is insertable into the ground to support the shaft means.

* * * * *